US008684352B2

(12) United States Patent
Kostudis et al.

(10) Patent No.: US 8,684,352 B2
(45) Date of Patent: Apr. 1, 2014

(54) SHEET INVERTER AND METHOD FOR INVERTING A SHEET

(71) Applicants: Dimitrios Kostudis, Wedel (DE); Volker Otto, Gettorf (DE); Rolf Spilz, Gettorf (DE)

(72) Inventors: Dimitrios Kostudis, Wedel (DE); Volker Otto, Gettorf (DE); Rolf Spilz, Gettorf (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/707,719

(22) Filed: Dec. 7, 2012

(65) Prior Publication Data

US 2013/0161903 A1 Jun. 27, 2013

(30) Foreign Application Priority Data

Dec. 21, 2011 (DE) ..... 10 2011 121 834

(51) Int. Cl.
*B65H 29/00* (2006.01)

(52) U.S. Cl.
USPC ..... 271/186

(58) Field of Classification Search
USPC ..... 271/186; 198/405
See application file for complete search history.

(56) References Cited

U.S. PATENT DOCUMENTS

| | | | | |
|---|---|---|---|---|
| 3,838,771 | A * | 10/1974 | Whiteford | 198/405 |
| 5,411,250 | A * | 5/1995 | Belec et al. | 271/185 |
| 6,626,103 | B2 | 9/2003 | Neumann | |
| 6,705,470 | B2 * | 3/2004 | Klein et al. | 209/534 |
| 2002/0104785 | A1 * | 8/2002 | Klein et al. | 209/534 |
| 2003/0034234 | A1 | 2/2003 | Neumann | |

FOREIGN PATENT DOCUMENTS

DE 10 2007 022 176 4/2009

* cited by examiner

*Primary Examiner* — David H Bollinger

(57) ABSTRACT

Sheet inverters and methods for inverting sheets are provided that guide longer length receivers through a 180 degree turn while the receivers are being transported along a transport path while reducing the possibility of jams, the extent of sheet stress experienced during inversion and reducing the risk of creating print artifacts.

17 Claims, 3 Drawing Sheets

SHEET INVERTER AND METHOD FOR INVERTING A SHEET

FIELD OF THE INVENTION

The present invention relates to a sheet inverter and a method for inverting sheets in a printing machine.

BACKGROUND OF THE INVENTION

In the printing industry, different types of sheet inverters are known, which are typically employed in a duplex path of a printing machine. One such type of sheet inverter, which is for example described in U.S. Pat. No. 6,626,103 B1, allows a leading edge of a sheet to remain the same before and after inversion. This may be beneficial to registered printing on the front and back side of the sheet.

This known sheet inverter has a first pair of spaced apart rollers having a first endless belt entrained thereabout in a figure eight configuration such that the first belt has a 180° twist in each section extending between the first pair of rollers and a second pair of spaced apart rollers having a second endless belt entrained thereabout in a figure eight configuration such that the second belt has a 180° twist in each section extending between the second pair of rollers. The first and second pairs of rollers are arranged adjacent to each other such that one section of the first belt and one section of the second belt, each belt having the 180° twist, contact each other to form a transport path therebetween. This is done by arranging one roller of the first pair of rollers and one roller of the second pair of rollers adjacent to each other to form an entrance group of rollers at an entrance of the transport part, and arranging one roller of the first pair of rollers and one roller of the second pair of rollers adjacent to each other to form an exit group of rollers at an exit of the transport path. The transport path thereby also has a 180° twist. The twist forces a sheet sandwiched and transported between the belts to be twisted along the line of contact and to turn by 180° while it is transported along the transport path through the inverter. The inverter also has a guide wire to guide an edge portion of the sheet over and across the transport path during turning of the sheet. The known guide wire is arranged to support the edge portion of the sheet in substance in accordance with the turning force impaired by the twist in the transport path, i.e. it is arranged to provide substantially the same turning rate as the one provided by the twist in the transport path.

This arrangement is suitable for a wide range of sheets, which may differ with respect to stiffness and dimensions. For long sheets, however, in particular sheets having a length (in the direction of transportation) longer than half the length of the transport path through the inverter, this arrangement may cause problems as described below. In this case, when the leading edge reaches the midpoint of the transport path, both the twist in the transport path and the guide wire will urge the sheet into an upright orientation. While the transport path urges the sheet in an upright orientation only in a middle section thereof, the guide wire urges the edge portions thereof in the upright orientation. When the sheet is longer than half the length of the transport path, the trailing edge will still be held in a horizontal position between the entrance group of rollers at the entrance end of the transport path. This may cause jams, undue stress in the sheet and may especially lead to artifacts in a printed image on a surface of the sheet due to excessive bending thereof. This problem is obviously more pronounced the longer and the stiffer the sheet.

It is therefore an object of the invention to provide a sheet inverter and a method for inverting a sheet in a printing machine, which may overcome or at least lessen one of the above problems.

SUMMARY OF THE INVENTION

In accordance with one aspect of the invention, a sheet inverter for inverting sheets in a printing machine is provided. The sheet inverter has a first pair of spaced apart rollers having a first endless belt entrained thereabout in a figure eight configuration such that the first belt has a 180° twist in each section extending between the first pair of rollers and a second pair of spaced apart rollers having a second endless belt entrained thereabout in a figure eight configuration such that the second belt has a 180° twist in each section extending between the second pair of rollers. The first and second pairs of rollers are arranged adjacent to each other such that one section of the first belt and one section of the second belt, each having the 180° twist; contact each other to form a transport path therebetween. The transport path thus has a 180° twist, which causes a central portion of a sheet, which is sandwiched between the belts, to turn over by 180° by following the twist in the transport path while the sheet is transported there along through the inverter. The inverter further has at least one guide unit, arranged to provide guidance to a first lateral portion of a sheet while it is transported along the transport path through the inverter. The at least one guide unit has a turning section, which crosses over the transport path from one side to an opposite side thereof and which is arranged to guide the lateral portion of the sheet to turn and move over the transport path by imparting a turning motion to the lateral portion of the sheet, the imparted turning motion having a substantially higher angular rate than a turning motion imparted by the twist in the respective section of the transport path. The term "substantially higher angular rate" is supposed to include the at least one guide to impart an angular turning rate to the edge region of the sheet which is at least 1.5 times higher than the angular twist rate. This allows the imparted turning of the first lateral portion of a sheet, caused by the guide unit, to be moved downstream along the transport path compared to the known guide wire. This may reduce stress in the sheet and in particular in long sheets having a length greater than half the length of the transport path.

In accordance with another aspect of the invention, a method is provided for inverting a sheet in a printing machine as it is transported through a sheet inverter having a first pair of spaced apart rollers having a first endless belt entrained thereabout in a figure eight configuration such that the first belt has a 180° twist in each section extending between the first pair of rollers, and a second pair of spaced apart rollers having a second endless belt entrained thereabout in a figure eight configuration such that the second belt has a 180° twist in each section extending between the second pair of rollers, the first and second pairs of rollers being arranged adjacent to each other, such that one section of the first belt and one section of the second belt, each having the 180° twist, contact each other to form a transport path therebetween, the transport path having a 180° twist. In the method, the first and second belts are caused to circulate about the first and second rollers such that the belt sections forming the transport path move in the same direction and at the same speed. A central portion of the sheet is transported between the belt sections forming the transport path such that it is sandwiched by the belt section and moved therewith and a turning motion is imparted to the central portion of the sheet by causing the central portion to follow the twist in the transport path while the sheet is transported along the transport path. Also, a turning movement is imparted to a first lateral portion of the sheet by at least one guide to cause the first lateral portion of the sheet to turn and thereby move over the transport path, the imparted turning motion having a substantially higher angular rate than a turning motion imparted to the central portion of the sheet in the respective section along the transport path.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
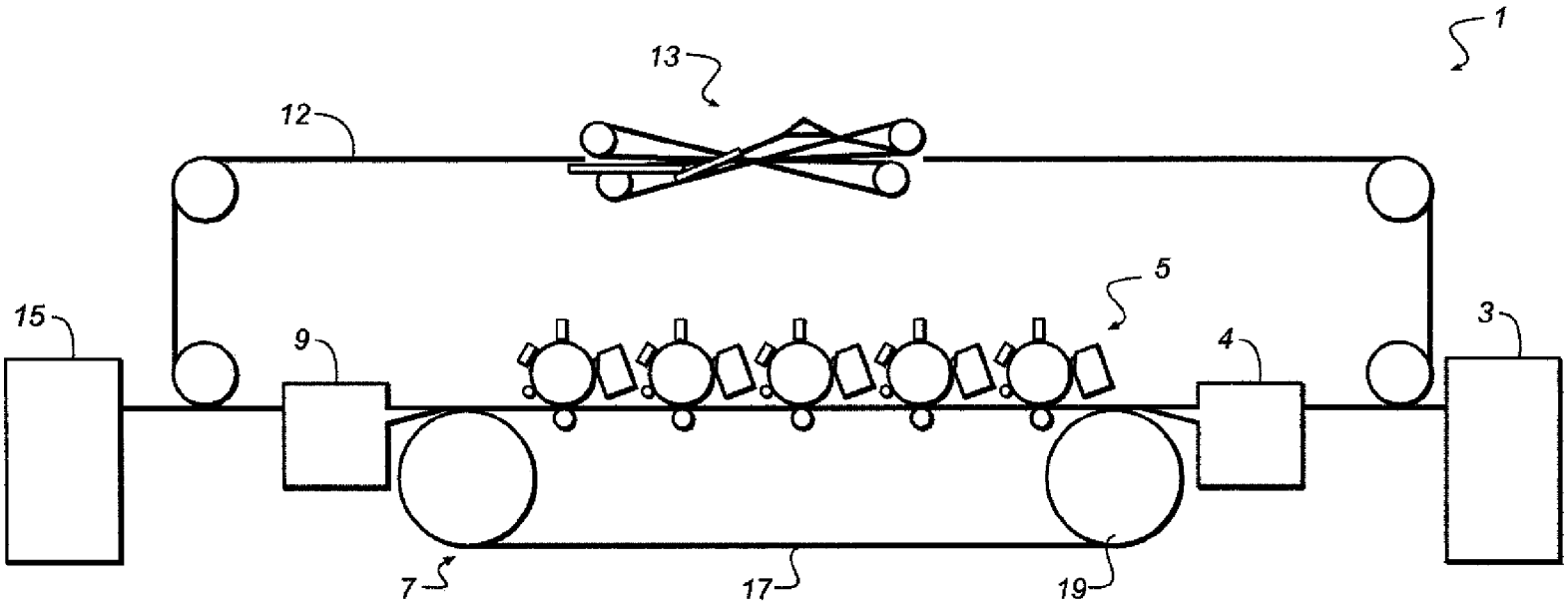
FIG. 1 is a schematic side view of a printing machine, in which an inverter according to the invention may be employed.

Terminology regarding locations and directions such as above, below, right and left, used throughout the description relates to the representations in the drawings and are thus not to be viewed in a limiting sense. However, they may also relate to a preferred final arrangement of components.

FIG. 1 shows a schematic side view of a multi-color printing machine 1, having a feeder 3, an alignment unit 4, a plurality of printing units 5, a transport unit 7, a fusing unit 9, a duplex path 12 with an inverter 13, as well as an output tray 15. Many different types of single or multi-color printing machines are known, and FIG. 1 depicts only a highly simplified example of such a printing machine 1.

The feeder 3 is disposed to hold a stack of sheets and to feed individual sheets to the alignment unit 4, and is shown at a first end of the printing machine 1. However, the feeder may also be arranged at any other location and need not feed sheets directly to the alignment unit 4. The alignment unit 4 is of a suitable type that aligns the sheets supplied thereto in a suitable manner and transfers them to the transport unit 7. The transport unit 7 is of a known type that is suitable to transport sheets past the printing units 5. In the depicted embodiment, the transport unit 7 comprises an endless transport belt 17 that is guided around corresponding transport and guide rollers 19.

The printing units 5 are arranged adjacent the transport belt 17 and are suitable for printing respective color separation images onto sheets that are transported by the transport belt 17 past the printing units 5. The multi-color printing machine 1 as shown has five printing units 5 but may have any number of printing units. The printing units 5 are shown as electrophotographic printing units, but they may also be of a different type, such as for example of the ink jet type, capable of transferring a print medium such as toner or ink to a sheet to form an image.

The fusing unit 9 is arranged downstream of the transport unit 7, to receive the sheets after printing thereon by the printing units 5. The fuser 9 may be of any suitable type for fusing or fixing the print medium previously printed onto the sheet. This may be accomplished, for example, by heated pressure rollers or also by other suitable devices such as, for example, a contactless heating device that operates with light or other electromagnetic radiation such as, for example, microwaves.

The fusing unit 9 is followed by the duplex path 12 that provides a sheet transport path back to the alignment unit 4. In the duplex path 12, the inverter 13, which will be described in more detail hereinbelow, is provided to invert a sheet that is being transported along the duplex path 12. If a sheet is not to be directed to the duplex path 12 after it has gone through the fusing unit 9, it is also possible to guide the sheet via an appropriate diverter to the output tray 15.

Figure 2:
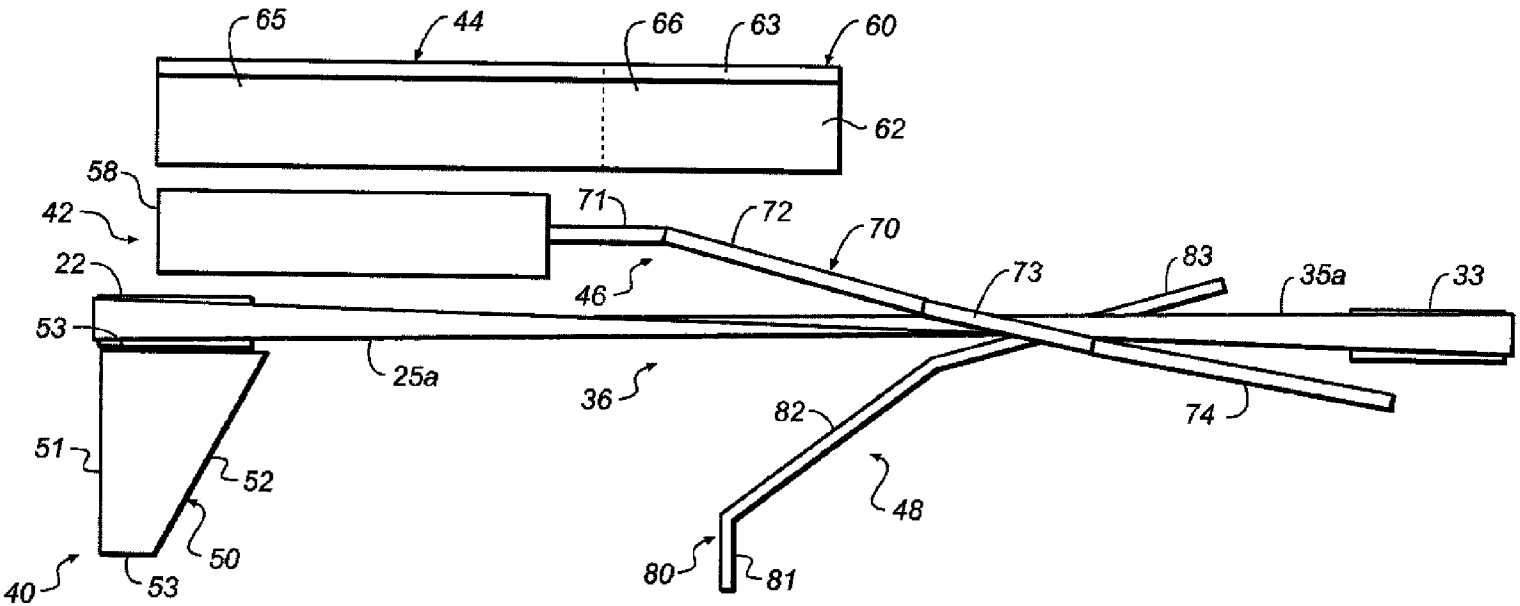
FIG. 2 is an enlarged schematic top view of the inverter shown in FIG. 1.
Figure 3:
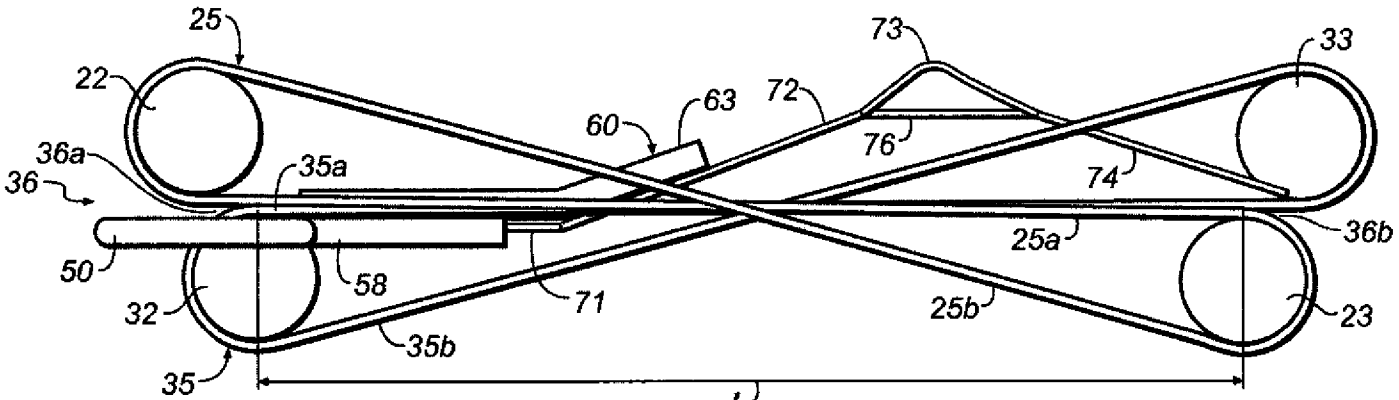
FIG. 3 is an enlarged schematic side view of the inverter shown in FIG. 1.

With reference to FIGS. 2 and 3, the inverter 13 will be described in more detail.

The inverter 13 has a first pair of spaced apart rollers 22, 23 having a first endless belt 25 entrained thereabout in a figure eight configuration. The first belt 25 has sections 25*a*, 25*b*, which in substance extend freely between the rollers 22, 23. The sections 25*a*, 25*b* each provide a 180° twist in the belt 25. The rollers 22, 23 are spaced in a horizontal direction and are offset by approximately the heights of one roller in a vertical direction, such that the belt section 25*a* extends in a substantially horizontal manner.

The inverter 13 has a second pair of spaced apart rollers 32, 33 having a second endless belt 35 entrained thereabout in a figure eight configuration. The second belt 35 has sections 35*a*, 35*b*, which in substance extend freely between the rollers 32, 33. The sections 35*a*, 35*b* each provide a 180° twist in the belt 35. The rollers 32, 33 are spaced in a horizontal direction and are offset by approximately the heights of one roller in a vertical direction, such that the belt section 35*a* extends in a substantially horizontal manner.

The first 22, 23 and second 32, 33 pairs of rollers are arranged adjacent to each other such that section 25*a* of the first belt 25 and section 35*a* of the second belt, contact each other over a substantial portion of the respective sections 25*a*, 35*a* to form a transport path 36 therebetween. At least one of the rollers 22, 23, 32, 33 may be connected to a driving mechanism (not shown) to rotate the same. In the embodiment as shown the rotation is such that the belt sections 25*a*, 35*a* of the first 25 and second 35 belt would move from left to right. The transport path 36 has a 180° twist, corresponding to the twist in the sections 25*a*, and 35*a* of the first 25 and second 35 belts, respectively. The twist would force a sheet, which is transported into the transport path, such that it is sandwiched between the belts 25, 35, to be twisted and turned over by 180° while the sheet is transported along the transport path 36 through the inverter 13. The rollers 22 and 32 form an entrance group of rollers for the transport path 36 as can be best seen in FIG. 3. Roller 22 is arranged above and slightly offset (to the left in FIG. 3) in the horizontal direction with respect to roller 32. The horizontal offset is beneficial in forming a flexible entrance nip 36*a* between the belt sections 25*a*, 35*a*. Similarly, rollers 23 and 33 respectively form an exit group of rollers for the transport path 36. Here, roller 33 is arranged above and slightly offset (to the right in FIG. 3) in the horizontal direction with respect to roller 23. The horizontal offset is beneficial in forming a flexible exit nip 36*a* between the belt sections 25*a*, 35*a*. With respect to FIG. 2, it should be noted that sections 25*b* and 35*b* of the belts 25 and 35 were omitted for ease of representation.

The rollers 22, 23 may be of the type as described in U.S. 2003/0034234 A1, which is incorporated herein by reference, having a circumferential recess for at least partially receiving the belt 25 and providing lateral guide surfaces for the belt. Additional guide rollers, contacting and guiding at least some of the belt sections as described in U.S. Pat. No. 6,626,103 B1, which is incorporated herein by reference, may be present.

The arrangement of the rollers 22, 32 of the entrance group and the rollers 23, 33 of the exit group in combination with the optional lateral guide surfaces and the optional additional guide rollers influence the twist in the respective sections 25*a* and 35*a*, which form the transport path 36. In particular, there is in substance no twist at the entrance and exit nips and directly adjacent thereto. Only some distance into the transport path, the twist starts and the main portion of the twist, i.e. more than 50% and preferably more than 70% or even more than 80% occurs in a middle section of the transport path. The transport path may be partitioned along its length l extending between the entrance nip 36*a* and the exit nip 36*b* into an entrance section, extending over the first quarter of the length, a midsection extending over the second and third quarter of the length and an exit section extending over the fourth quarter of the length. As indicated above, the main twist occurs in the middle section, which is thus also termed the operating section of the transport path. In the operating section, the angular twist rate provided by the belt sections 25*a* and 35*a* is in substance constant.

With respect to FIG. 3, it is noted that the twist in the belt sections 25*a* and 35*a* is arranged such that an area of a sheet being transported through the transport path 36, which at the entrance section lies behind the belts 25, 35 will be moved from a substantially horizontal orientation upwards and over the belt sections 25*a*, 35*a*. Similarly, an area of the sheet, which at the entrance section lies in front of the belts 25, 35 will be moved from a substantially horizontal orientation downwards and under the belt sections 25*a*, 35*a*.

The inverter 13 further has several guide units 40, 42, 44, 46, and 48 for guiding lateral regions of a sheet being transported through the inverter 13, i.e. regions which are not sandwiched by the belt sections 25*a* and 35*a*. These lateral regions may also be called edge regions. With respect to FIG. 3, it is to be noted that the guide unit 48 was omitted for ease of representation.

Guide unit 40, which is best seen in FIG. 2, is formed as a guide plate 50 having a leading edge 51, facing upstream of the transport path 36, a trailing edge 52, facing downstream of the transport path 36, and two lateral edges 53 extending parallel to the transport path 36. The plate 50 is arranged in substance horizontally and slightly below the transport path 36 in the vicinity of the entrance nip. It is arranged on that side of the transport path 36, where the edge region of a sheet will move downwards. The leading edge 51 extends at a right angle to the transport path 36. The trailing edge extends at such an angle to the transport path such that the plate tapers outwardly, i.e. away from the transport path 36. As can be seen by the skilled person, due to the taper, the plate 50 will provide lesser support to outer edge regions of a sheet compared to more central regions thereof. This allows an outer edge of the sheet to move downward earlier than a central portion thereof. The upper surface of the plate 50 and the surface of the trailing edge may be of a material having a low coefficient of friction, such as PTFE.

Guide unit 42, which is also best seen in FIG. 2, is formed as a guide plate 58 having an elongated rectangular shape. The plate 58 is arranged in substance horizontally and slightly below the transport path 36. The plate 58 is arranged on that side of the transport path 36, where the edge region of a sheet will move upwards, and the plate extends lengthwise over approximately the entrance section of the transport path 36. The upper surface of the plate 58 may be of a material having a low coefficient of friction, such as PTFE.

Guide unit 44, is formed as a guide element 60 having a bottom wall 62 and a side wall 63, the side wall 63 extending in substance perpendicular to the bottom wall 62. The bottom wall 62 has a first section 65 and an adjacent second section 66. The first section 65 is arranged upstream of the second section 66 with respect to the direction of the transport path 36. The first section 65 has a top surface, which is arranged in substance horizontally and slightly below the transport path 36, at approximately the same height as plate 58. The second section 66 has planar a top surface, which is angled upwards with respect to the first section 65, such that it extends from a position below the transport path 36 to a position above the transport path 36, as can be best seen in FIG. 3. In this respect it should be noted that the side wall 63 extends upwards from the bottom wall 62 both in the first 65 and second 66 sections thereof and provides a lateral abutment for a sheet transported through the inverter 13, in case the sheet is skewed or moves sideways in this direction. The guide element 60 is arranged on that side of the transport path 36, where the edge region of a sheet will move upwards, i.e. the same side as plate 58. Guide element 60 is arranged further away from the transport path 36 than plate 58, i.e. plate 58 is arranged between guide element 60 and transport path 36. The guide element 60 extends lengthwise over the entrance section of the transport path 36 and approximately half the midsection thereof. The second section 66 extends lengthwise along the middle section of the transport path 36. The upper surface of bottom wall 62 and the inner surface of side wall 63, i.e. the surface facing towards the transport path 36, may be of a material having a low coefficient of friction, such as PTFE.

Guide unit 46 is formed as a wire 70 having several different sections along its extension. As shown, the wire 70 has a first section 71, a second section 72, a third section 73 and a fourth section 74. Furthermore a separate bridge section 76 is provided, as will be explained hereinbelow. The sections are arranged in the above order along the wire 70 and in the direction of the transport path 36.

The first section 71 is in substance a straight wire section, which is arranged in substance horizontally and slightly below the transport path 36. The first section 71 extends in substance parallel to the transport path (in a lateral sense), as can be seen in the top view of FIG. 2. The section 71 basically may be seen as a (partial) extension of the guide surface provided by plate 58. The plate 58 and the section 71 of the wire 70 thus provide guidance to a lateral portion of a sheet being transported along the transport path in substance parallel to the transport path over a substantial length thereof. Substantially parallel as used herein is supposed to encompass angular deviations of less than 10°, preferably less than 5°. The term over a substantial length is supposed to encompass at least ¼ of a length/of the transport path, and preferably at least ⅓ of the length.

The second section 72 is in substance also a straight wire section. The second section 72 is angled upwards with respect to the horizontal orientation of the first section 71. The second section angles upwards at approximately the same angle as the second section 66 of bottom wall 62 of guide element 60. The second section 72 is also angled with respect to the (lateral) parallel extension of the first section 71. The second section 72 is angled towards the transport path 36. A downstream end (in the direction of the transport path) of the section 72 is thus arranged vertically above the transport path 36 (best seen in FIG. 3) and in a lateral sense directly adjacent thereto (best seen in FIG. 2). In the direction of the transport path, the second section 72 may be said to extend in the midsection thereof and in particular extends from the second quarter to the third quarter along the length l of the transport path 36.

The third section 73 is a curved wire section. The curve initially defines a slope steeper than a slope of the second section 72 defined by its upward angle. The curve is arranged to change the overall orientation of the wire from an upwards incline to a downwards incline as best seen in FIG. 3. The third section 73 is arranged to cross the transport path 36 from a first lateral side thereof to the opposite lateral side, as best seen in the top view of FIG. 2. In the direction of the transport path, the third section 73 extends mainly in the third quarter along the length l of the transport path 36 and the third section crosses the transport path in the last third of the midsection and preferably in the second half of the third quarter along the length l of the transport path 36 (corresponding to the last quarter of the midsection, which forms the operating section).

The fourth section 74 is in substance again a straight wire section. The fourth section 74 is angled downwards (i.e. in heights) towards the transport path 36 (best seen in FIG. 3). In a lateral sense, the fourth section 74 is angled away from the transport path 36 (best seen in FIG. 2). The free end of the fourth section ends in the vicinity of the exit nip 36*b* of the transport path, at a laterally spaced position (best seen in FIG. 2) and just above the transport path (best seen in FIG. 3).

The bridge section 76 is in substance a straight wire, which extends between the opposite ends of the third section 73 of the wire guide 70 and is connected thereto in any appropriate manner such as soldering, brazing, welding, gluing, etc.

Guide unit 48, which is only shown in FIG. 2, is formed as a wire 80 having several different sections along its extension. As shown, the wire 80 has a first section 81, a second section 82, and a third section 83. The sections are arranged in the above order along the wire 80 and in the direction of the transport path 36.

The first section 81 is in substance a straight wire section, which extends in substance perpendicular from a free end towards the transport path 36. The first section 81 is inclined upwards with respect to the horizontal orientation of the transport path 36 from said free end. The free end may be positioned just about at the level of the transport path and the opposite end of the section 81 is positioned above the transport path 36.

The second section 82 is in substance also a straight wire section. The second section 82 is angled downwards with respect to the horizontal orientation of the transport path 36. The second section 82 is angled (laterally) with respect to the perpendicular extension of the first section 81 such that it extends at an angle into the direction of the transport path. The second section 82 thus extends laterally towards the transport path. The second section 82 ends before crosses the transport path 36. The downward angle is chosen such that the end of the second section which is distanced from the first section is positioned below the transport path. In the direction of the transport path, the second section 82 may be said to extend in the midsection thereof and in particular extends from the second quarter to the third quarter along the length l of the transport path 36.

The third section 83 is another straight wire section. The third section 83 in angled downward at an angle which is less steep than the downward angle of the second section. The third section is also angled in a lateral sense towards the transport path 36 such that it crosses the same in the lateral direction. As will be understood, the third section crosses under the transport path 36. The third section is arranged to cross under the transport path 36 at a position along the length l of the transport path which lies in the last third of the midsection and preferably in the second half of the third quarter along the length l of the transport path 36 (corresponding to the last quarter of the midsection, which forms the operating section). The crossing may in the direction of the transport path 36 be at the same position as the crossing of the third section 73 of wire 70. The third section 83 ends shortly after crossing under the transport path. Another guide unit, not shown, providing an upwardly angled guide such as the one described in DE 10 2007 022 176, which is incorporated herein by reference, may be provided downstream of the third section 83 of wire 80. Alternatively, the wire 80 may also have a straight or curved fourth section providing an upwardly and outwardly extending guide surface for a sheet.

Operation of the printing machine 1 and in particular of inverter 13 will be described hereinbelow with reference FIGS. 1 to 3, using the example of duplex printing on a sheet, such as a paper sheet, via electrophotographic printing units.

First, feeder 3 is used to place a sheet against the alignment unit 4, and the sheet is suitably aligned. Subsequently, the sheet is transferred to the transport belt 17 of the transport unit 7 and, for example, held thereon in an electrostatic manner. The transport belt 17 is transported in a circulating manner in order to guide the sheet along the printing units 5, which provide a toner image on an upwardly facing first side of the sheet. Due to the plurality of printing units, different color separation images of a multi-color printed picture are suitably transferred to the sheet. Now the sheet with the toner layers applied thereto is guided through the fusing unit 9 in which the toner image is fused. Subsequently, the sheet is guided to the duplex path 12, where the sheet is turned by the inverter 13 and is then applied to the alignment unit 4 in an inverted manner, i.e. the first side on which was previously printed is now facing downwards. The sheet is again suitably aligned and then transferred to the transport belt 17 to be transported along the printing units 5 for transferring a toner image to the second side of the sheet. This toner image is then fused to the sheet in fusing unit 9 and the sheet is subsequently transported to output tray 15.

The inversion process is now described in more detail with reference to FIGS. 2 and 3. The sheet is transported into inverter 13, such that a central portion thereof (i.e. central with respect to a direction transverse to the direction of transport) is received between belt sections 25*a* and 35*a* of belts 25 and 35. A leading edge of the sheet will first enter the entrance nip 36*a* and will then be transported along the transport path 36. During the movement of the sheet along the transport path 36, the central portion thereof will follow in substance the twist in the transport path as described above.

When the leading edge of the sheet enters nip 36*a*, lateral portions of the sheet will be supported by plate 50 of guide unit 40, plate 58 of guide unit 42 and bottom wall 62 of guide unit 44. On the side of plate 50, the support will decrease from the outside edge of the sheet towards the central portion thereof, while the sheet is moved along the transport path 36, due to the taper of plate 50. This allows the sheet portion arranged on this side of the transport path to first move downwards at an outer section thereof compared to a more central section. Once the trailing edge of the sheet moves over the plate 50, the edge 52 avoids a spontaneous rotation of this portion of the sheet, as the support is sequentially decreased towards the central portion.

On the other side, of the transport path 36 the lateral portion of the sheet will be supported by plate 58 of guide unit 42 and if it has a sufficient width (which is assumed in the following) also by bottom wall 62 of guide element 60 of guide unit 44. With respect to bottom plate 62, the sheet will initially be supported by the first section 65, extending horizontally.

Upon movement of the sheet along the transport path 36, the lateral portion will lose support by the plate 58 when the leading edge of the sheet moves over the end of plate 58. The lateral portion of the sheet will then be supported by the first section 71 of wire 70 of guide unit 46 and also bottom wall 62 of guide element 60.

Once the leading edge of the sheet reaches the second section 72 of the wire 70, the respective lateral portion will be supported mainly by the second section 72 of the wire 70 and an outer edge thereof may still be supported by the bottom wall 62 of guide element 60, albeit the second, upwardly inclined section 66 thereof. Due to the upward slope of the second section 72 and the second section 72 also being angled (in a lateral sense) towards the transport path, upon further movement of the sheet, the lateral portion will be moved upwards and into a turning motion. The turning motion imparted to the lateral portion of the sheet by the second section 72 of wire 70 starts later than the turning motion imparted to a central portion of the sheet by the twist in the transport path. The turning motion imparted by the second section 72 of wire 70, however, has a substantially higher angular rate than the one imparted by the twist in the respective section of the transport path.

The angular rate of the turning motion imparted to the lateral portion of the sheet by the second section 72 of wire 70 while the sheet is transported along the transport path 36—is at least 1.5 times (preferably at least 2 times) higher than the angular turning rate imparted to a central portion of the sheet imparted by the twist in the transport path. Thus, even though the turning motion imparted to the lateral portion of the sheet starts later than the turning motion imparted to a central portion thereof, the turning rate at the lateral portion is higher, such that it will gain upon the turning of the central portion. Assuming a sheet having a length (in the direction of the transport path) which is longer than half the length of the transport path, this delayed turning motion of the lateral portion may reduce stress in the sheet compared to a turning motion imparted to the lateral portion which in substance follows the turning motion imparted to the central portion of the sheet. As will be realized, the lateral portion may remain in a flatter configuration for a longer time. The higher turning rate imparted by the second section 72 of wire 70 ensures that the lateral portion gains upon the turning of the central portion and thus facilitates in cooperation with the third 73 and fourth 74 sections of wire 70 that the turning motion will be complete before the leading edge of the sheet reaches the exit nip 36*b* of the transport path 36.

Once the leading edge of the sheet reaches the third section 73 of wire 70, the lateral portion will be supported and further turned by the curved section of wire 70 and also the bridge section 76. The angular turning rate imparted to the lateral portion of the sheet in the third section 73 is again substantially higher than the one imparted to respective central portion of the sheet by the transport path. At least at the point where the third section crosses over the transport path, the lateral portion of the sheet will take an upright orientation or will actually already begin to fall over to the other side. While the bridge section 76 will provide guidance to an intermediate lateral portion of the sheet, the curved portion of wire 70 will draw out any possible curl formed at a lateral edge portion of the sheet to ensure the lateral edge portion to flip over after sheet passes the upright orientation. As previously explained, the third section 72 crosses over the transport path in the last third, preferably the last quarter of the midsection, i.e. the operative section. Thus, the lateral portion will reach the upright orientation downstream of the central portion reaching the upright orientation, which is approximately at the midpoint along the transport path 36. One the leading edge reaches the crossing over position of the third section (which may correspond to a midpoint of the third section), it is preferred that the trailing edge of the sheet has passed the entrance nip 36*a*, i.e. the position of the cross over point may preferably be chosen in accordance with the longest sheet to be guided through the inverter 13. In so doing, at the point in time when the front edge would start to flip over on its own, the central portion of the sheet at the trailing edge is free to move, i.e. it is no longer tightly clamped between the rollers 22, 32 at the entrance nip. However, even if the trailing edge is still in the entrance nip, when the leading edge of the sheet reaches the cross over point of the third section 73, the delayed upright orientation of the lateral portion of the sheet and the high angular turning rate imparted to the lateral portion are beneficial in reducing stress in the sheet.

When the leading edge of the sheet moves along the fourth section 74 of wire 70, the wire ensures the lateral portion at the leading edge to completely turn over before the leading edge of the sheet reaches the exit nip 36*b* of the transport path 36.

From the above it becomes clear that the wire 70 guides a lateral portion of the sheet to turn while it passes over the transport path 36. In a similar manner, wire 80 of guide unit 48 is arranged to guide another lateral portion of the sheet (located on the other side of the transport path to the lateral portion guided by wire 70) to turn while it passes under the transport path 36.

As described above, the lateral portion on the side of plate 50 is only supported in the vicinity of the entrance nip 36*a* of the transport path. Past the plate 50, the lateral portion of the sheet may move downwards due to gravity and due to the turning motion imparted by the transport path 36. This downward movement may be inhibited by the inherent stiffness of the sheet, and in some instances even a slight upward movement of a lateral edge of the sheet may occur due to the sheet curling. Once the leading edge of the sheet reaches the first section 81 of the wire, 80, the upwards extension of this sections 81 ensures that the respective lateral portion of the sheet will be caught under the wire 80. When the leading edge of the sheet moves along the second section 82 of wire 80, the lateral portion of the sheet will be guided downwards and into a turning motion. The angular rate of the turning motion imparted by the second section 82 is again substantially higher than the turning motion imparted to the respective central portion of the sheet. The imparted angular turning rate may be similar to the one imparted by the second section 72 of the wire 70. When the leading edge of the sheet moves along the third section 83 of the wire 80, the third section 83 forces the lateral portion of the sheet into a substantially downright orientation and to pass under the transport path 36. The lateral portion of the sheet will be forced in the downright orientation at approximately the same point along the transport path at which the other lateral portion of the sheet will be forced in the upright orientation. Here, the third section may end or may extend a little bit further and another guide element (not shown may be provided to support an upwards movement and further turning of the lateral section of the sheet at the other side of the transport path 36.

The invention has been described in detail with particular reference to certain preferred embodiments thereof, but it will be understood that variations, combinations, and modifications can be effected by a person of ordinary skill in the art within the spirit and scope of the invention.

What is claimed is:

1. A sheet inverter for inverting sheets in a printing machine, said sheet inverter comprising:

a first pair of spaced apart rollers having a first endless belt entrained thereabout in a figure eight configuration such that the first endless belt has a 180° twist in each section extending between said first pair of rollers;

a second pair of spaced apart rollers having a second endless belt entrained thereabout in a figure eight configuration such that the second endless belt has a 180° twist in each section extending between said second pair of rollers, said first and second pairs of rollers being arranged adjacent to each other such that one section of said first endless belt and one section of said second endless belt, each having said 180° twist, contact each other to form a transport path therebetween, said transport path having a 180° twist, said twist of the transport path imparting a central portion of a sheet, which is sandwiched between the belts, to turn over by 180° by following the twist in the transport path while the sheet is transported there along through the inverter; and at least one guide unit, said guide unit being arranged to provide guidance to a first lateral portion of a sheet while it is transported along the transport path through the inverter, said guide unit has a turning section, which crosses over the transport path from one side to an opposite side thereof and which is arranged to guide the first lateral portion of said sheet to turn and move over the transport path by imparting a turning movement to the first lateral portion of the sheet, the imparted turning motion having a substantially higher angular rate than a turning motion imparted by the twist in the respective section of the transport path.

2. The sheet inverter of claim 1, wherein said sections of the first and second belt contacting each other are arranged to provide a substantially constant angular twist rate along a midsection transport path.

3. The sheet inverter of claim 1, wherein said turning section is arranged to cause the first lateral portion of the sheet to turn over with at least twice the angular rate compared to the central portion thereof.

4. The sheet inverter of claim 1, wherein said transport path has a length/and said turning section is arranged to cross the transport path along its length/at a position which is within a last third of a midsection thereof.

5. The sheet inverter of claim 4, wherein said turning section is arranged to cross the transport path along its length l at a position which is within a last quarter of the midsection thereof.

6. The sheet inverter of claim 1, wherein said at least one guide unit, comprises a guide section extending substantially parallel to the transport path over a substantial length thereof.

7. The sheet inverter of claim 6, wherein at least said turning section of the guide unit is formed by a wire guide.

8. The sheet inverter of claim 1, comprising at least one further guide unit, said further guide unit being arranged to provide guidance to a second lateral portion of a sheet, which is opposite to the first lateral portion with respect to the central portion of the sheet, while it is transported along the transport path through the inverter, said further guide unit has a turning section, which crosses under the transport path from one side to an opposite side thereof and which is arranged to guide the lateral portion of said sheet to turn and move under the transport path by imparting a turning movement to the second lateral portion of the sheet, the imparted turning motion having a substantially higher angular rate than a turning motion imparted by the twist in the respective section of the transport path.

9. The sheet inverter of claim 1, further comprising at least one support element arranged adjacent to an entrance portion of said transport path, said support element having an edge facing in the direction of transport of the transport path which tapers inwards towards the transport path.

10. A method for inverting a sheet as it is transported through a sheet inverter having a first pair of spaced apart rollers having a first endless belt entrained thereabout in a figure eight configuration, such that the first endless belt has a 180° twist in each section extending between said first pair of rollers, and a second pair of spaced apart rollers having a second endless belt entrained thereabout in a figure eight configuration, such that the second endless belt has a 180° twist in each section extending between said second pair of rollers, said first and second pairs of rollers being arranged adjacent to each other such that one section of said first endless belt and one section of said second belt, each having said 180° twist, contact each other to form a transport path therebetween, said transport path having a 180° twist, said method comprising:

causing the first and second endless belts to circulate about the first and second rollers such that the belt sections forming the transport path move in the same direction and at the same speed;

transporting a central portion of a sheet between the belt sections forming the transport path such that it is sandwiched by the belt sections and moved therewith;

imparting a turning motion to the central portion of the sheet by causing the central portion to follow the twist in the transport path while the sheet is transported along the transport path; and imparting a turning movement to a first lateral portion of the sheet by at least one guide to cause the first lateral portion of said sheet to turn and thereby move over the transport path, the imparted turning motion having a substantially higher angular rate than a turning motion imparted to the central portion of the sheet in the respective section along the transport path.

11. The method of claim 10, wherein said sections of the first and second belt contacting each other impart a substantially constant angular twist rate over a midsection of the transport path.

12. The method of claim 10, wherein the angular turning rate of the turning movement imparted to the first lateral portion of the sheet is at least twice the imparted turning motion imparted at the central portion thereof.

13. The method of claim 10, wherein said transport path has a length l and the first lateral portion of the sheet is guided by said at least one guide such that it reaches a substantially upright orientation at a position along the length l of the transport path which is within a last third of a midsection thereof.

14. The method of claim 13, wherein said substantially upright orientation is reached at a position along the length l of the transport path which is within a last quarter of the midsection thereof.

15. The method of claim 10, wherein said first lateral portion is guided substantially parallel to the transport path over a substantial length l of the transport path.

16. The method of claim 10 further comprising:

imparting a turning movement to a second lateral portion of the sheet, which is opposite to the first lateral portion with respect to the central portion, the turning movement being imparted by at guide and causes the second lateral portion of the sheet to turn and thereby move under the transport path, the imparted turning motion having a substantially higher angular rate than a turning motion imparted to the central portion of the sheet in the respective section along the transport path.

17. The method of claim 16, wherein said second lateral portion of the sheet is guided by said guide such that it reaches a substantially downright orientation at a position along the length l of the transport path at approximately the position where the first lateral portion reaches the substantially upright orientation.

* * * * *